US009991078B2

(12) United States Patent
Ao et al.

(10) Patent No.: US 9,991,078 B2
(45) Date of Patent: Jun. 5, 2018

(54) SHORT-CURRENT PROTECTION ACTION CURRENT ADJUSTING METHOD AND DEVICE THEREOF AND DEVICE FOR MULTI-POLE ELECTROMAGNETIC RELEASE

(71) Applicant: NOARK Electrics (Shanghai) Co. Ltd., Shanghai (CN)

(72) Inventors: Denggui Ao, Shanghai (CN); Yongfu Xu, Shanghai (CN); Yuming Duan, Shanghai (CN)

(73) Assignee: NOARK ELECTRICS (SHANGHAI) CO. LTD. (CN)

( * ) Notice: Subject to any disclaimer, the term of this patent is extended or adjusted under 35 U.S.C. 154(b) by 0 days. days.

(21) Appl. No.: 15/322,388

(22) PCT Filed: Jan. 16, 2015

(86) PCT No.: PCT/CN2015/070833
§ 371 (c)(1),
(2) Date: Dec. 27, 2016

(87) PCT Pub. No.: WO2015/196797
PCT Pub. Date: Dec. 30, 2015

(65) Prior Publication Data

US 2017/0133186 A1 May 11, 2017

(30) Foreign Application Priority Data

Jun. 24, 2014 (CN) ..... 2014 1 0290178

(51) Int. Cl.
*H01H 9/00* (2006.01)
*H01H 71/24* (2006.01)
(Continued)

(52) U.S. Cl.
CPC ..... *H01H 71/24* (2013.01); *H01H 50/18* (2013.01); *H01H 50/36* (2013.01); *H01H 71/74* (2013.01)

(58) Field of Classification Search
CPC ..... H01H 71/7463
(Continued)

(56) References Cited

U.S. PATENT DOCUMENTS 3,575,679 A * 4/1971 Ellsworth ..... H01H 71/7463 335/176
4,249,151 A * 2/1981 Esteves ..... H01H 71/7463 335/176
(Continued)

FOREIGN PATENT DOCUMENTS

CN 1087748 6/1994
CN 1815660 8/2006
(Continued)

OTHER PUBLICATIONS

International Search Report dated Apr. 1, 2015 issued in corresponding International patent application No. PCT/CN2015/070833.
(Continued)

*Primary Examiner* — Alexander Talpalatski
(74) *Attorney, Agent, or Firm* — Ostrolenk Faber LLP

(57) ABSTRACT

A short-circuit protection action current adjusting method and a device thereof for a multi-pole electromagnetic release. An electromagnetic system includes an auxiliary static iron core, a second static iron core, a coil, a reset spring and a dynamic iron core; at an initial position, a first gap is formed between the auxiliary static iron core and the dynamic iron core, a second gap is formed between the dynamic iron core and the second static iron core, and the thickness of the second gap changes in the same direction
(Continued)

along with the size variation of a release threshold; the elastic force of the reset spring changes oppositely along with the size variation of the release threshold; when a release current value is adjusted from large to small, the coil energy reduces in a quadratic relationship mode along with flowing currents and meanwhile the electromagnetic attraction between the dynamic iron core and the second static iron core is increased in a quadratic relationship mode, which is in inverse proportion to reduction of the thickness of the second gap. According to the short-circuit protection action current adjusting method and device thereof for the multi-pole electromagnetic release, adjustment of the release current value and electromagnetic attraction required by actions of the dynamic iron core are in a linear fixed corresponding relationship due to automatically achieved balance between two quadratic functions, and adjustment of the release threshold through the user is convenient, reliable and stable.

8 Claims, 4 Drawing Sheets

(51) Int. Cl.
*H01H 71/74* (2006.01)
*H01H 50/18* (2006.01)
*H01H 50/36* (2006.01)

(58) Field of Classification Search
USPC ..... 335/176, 42, 237
See application file for complete search history.

(56) References Cited

U.S. PATENT DOCUMENTS

| | | | | |
|---|---|---|---|---|
| 4,399,421 | A * | 8/1983 | MacLean | H01H 83/20 335/174 |
| 4,973,928 | A * | 11/1990 | Grunert | H01H 71/7463 335/176 |
| 4,983,939 | A * | 1/1991 | Shea | H01H 71/7463 335/172 |
| 5,467,069 | A | 11/1995 | Payet-Burin et al. | |
| 6,218,921 | B1 * | 4/2001 | Eberts | H01H 71/322 335/172 |
| 6,930,575 | B2 * | 8/2005 | Azzola | H01H 71/7463 335/176 |
| 9,070,519 | B2 * | 6/2015 | Marushima | H01H 33/40 |
| 2014/0054148 | A1 * | 2/2014 | Marushima | H01H 3/32 200/400 |

FOREIGN PATENT DOCUMENTS

| | | |
|---|---|---|
| CN | 201311895 | 9/2009 |
| CN | 201773759 | 3/2011 |
| CN | 201845732 | 5/2011 |
| CN | 201868177 | 6/2011 |
| CN | 202996744 | 6/2013 |
| CN | 103871797 | 6/2014 |
| CN | 104124114 | 10/2014 |
| CN | 204118016 | 1/2015 |
| FR | 2 991 098 A1 | 11/2013 |

OTHER PUBLICATIONS

Chinese Search Report dated Sep. 21, 2015 issued in corresponding Chinese patent application No. 201410290178.4.

* cited by examiner

SHORT-CURRENT PROTECTION ACTION CURRENT ADJUSTING METHOD AND DEVICE THEREOF AND DEVICE FOR MULTI-POLE ELECTROMAGNETIC RELEASE

CROSS REFERENCE TO RELATED APPLICATIONS

The present application is a 35 U.S.C. § 371 National Phase conversion of PCT/CN2015/070833, filed Jan. 16, 2015, which claims benefit of Chinese application no. 201410290178.4, filed Jun. 24, 2014, the disclosures of which are incorporated herein by reference in their entirety. The PCT International Application was published in the Chinese language.

TECHNICAL FIELD

The present invention relates to an electromagnetic release of a low-voltage multi-pole circuit breaker, in particular to an instantaneous release, more particularly a short-circuit protection action current adjusting method for a multi-pole electromagnetic release and a device implemented by adopting the method.

BACKGROUND ART

It is well-known that a low-voltage circuit breaker is a switching device having a protection function and has the most basic functions such as overload protection and short-circuit protection, wherein the short-circuit protection is executed through an instantaneous release. As stipulated in UL489 standard, the instantaneous release needs to possess a set function of adjustable release threshold, that is, a release current action preset value (hereinafter referred to as a "release threshold") of the release can be adjusted by operating a rotary knob on the release, and therefore, the release with such function is generally referred to as an instantaneous adjustable release. The release threshold described here refers to a set value associated with a design allowable maximum of a short-circuit current, and is generally set by a rated current of the circuit breaker. The release threshold adjustable function of the instantaneous adjustable release means that a release current threshold is adjustable, such that one electromagnetic release can satisfy the requirement of adjusting the maximum allowable value of the short-circuit current under different working conditions, or can satisfy the requirements of a circuit breaker in case of different rated currents. A frequently-used instantaneous adjustable release, for example an electromagnetic release, generally comprises an electromagnetic coil, a magnetic yoke, a dynamic iron core, a static iron core and a reset spring. Under normal circumstances, a current flowing through the electromagnetic coil is smaller than the release threshold, the dynamic iron core keeps separated from the static iron core under the action of the elastic force of the reset spring, and an air gap having a certain thickness is formed between the dynamic iron core and the static iron core; when an actual current flowing through the electromagnetic coil is equal to or larger than the release threshold, the dynamic iron core generates a release action immediately, and because the electromagnetic attraction between the dynamic iron core and the static iron core becomes larger than the elastic force of the reset spring, the dynamic iron core can move toward the static iron core against the elastic force of the reset spring till being attracted with the static iron core, and the movement of the dynamic iron core toward the static iron core triggers a trip lever of the circuit breaker to act and renders the circuit breaker to realize instantaneous release trip, thereby playing a short-circuit protection role.

However, The problems of instable action value and poor reliability are generally present in the current instantaneous adjustable release, and especially it is difficult for designers to solve the problems of instable action value and poor reliability for a long time while designing an instantaneous adjustable release of a relatively low current (less than 100 A, for instance). The applicant finds that a function model involved in adjustable release action current has the characteristics of multivariate and complicated function relationships upon the analysis of the reason and is formed by recombining two models, namely an electromagnetic model and a mechanical model. According to the current design of the instantaneous adjustable release, because 1, a variable associated with adjustment of a release action current and a function relationship between the variable and the adjustment of the release action current are ignored, and 2, there is no essential balanced scientific planning among various variant elements of an adjustable release system to result in imbalance of more variant elements owing to simultaneous adjustment and thus result in out of control of physical characteristics and mechanical characteristics of the adjustable release, this must make the adjustable release undergo a series of problems, such as instable action value and poor reliability, and meanwhile the adjustable range of the release threshold cannot be expanded. In a solenoid electromagnetic trip disclosed by the Chinese patent (ZL200820214752.8), the length of a spring is adjusted by a rotary knob to realize linear adjustment of a short-circuit current; a magnetic gap can be trimmed by an adjusting screw assembly arranged on a magnetic yoke to eliminate the inconformity of a release current setting value caused by parts themselves and assembly and solve the conformity of an initial setting value better; however, because this variable of the magnetic field energy of an electromagnetic coil and a function relationship in which this variable is in direct proportion to the quadratic of the release action current are ignored in the prior art, and in addition, the problems of poor instability and poor reliability are still present as it is not considered that a function relationship between the electromagnetic attraction between the dynamic iron core and the static iron core and the release action current is a complicated nonlinear non-trigonometric function relationship, this is a common representative example of an electromagnetic release having an adjustable release threshold designed on the basis of an elastic force balance principle. Therefore, this kind of prior art products certainly has the following defects: 1, the proportion of leakage flux of the magnetic gap in the magnetic field energy of the electromagnetic coil increases significantly as the magnetic field energy of the electromagnetic coil reduces significantly, and therefore, there is a great error between a release current indicated by adjusting the rotary knob and the actual release action current value, and especially in case of a low release current, this error and the instability are more serious, thereby further greatly limiting an adjustable range of the release action current. 2. Because there is no structure of a balance planning designed among variant elements of the electromagnetic release system, the adjusting error of the release current is very to sensitive to a manufacturing error, and even in case of trimming the magnetic gap by an adjusting screw, only the inconformity of initial states of various phases of releases can be improved, without solving the inconformity between the release threshold of the electromagnetic release of each phase under each adjusting state and the actual release action current value. 3. Because the actual release action current value and the elastic force of the reset spring are not in a linear function relationship, the adjustable range of the release threshold is relatively small, and the problems of the working stability and the release reliability under a state of a small release threshold are more prominent. 4. Because it is necessary for the adjustable release based on the elastic force balance principle to arrange the reset spring outside a coil, not only complicated structure, large volume and difficulty to mount and debug will be caused, but also there is also a need to increase such sliding fit pair, such as a short shaft and a sliding groove, so that the parallelism between the reset spring and the movement direction of the dynamic iron core cannot be ensured (it is even impossible to realize coaxiality), and therefore, it is certain to intensify the problems of instable action value and poor reliability of the release action value, as well as large error and instability between the set release threshold and the actual release action current value.

SUMMARY OF THE INVENTION

In order to overcome numerous defects of the prior art of an adjustable release based on an elastic force balance principle, an objective of the present invention is to provide a short-circuit protection action current adjusting method for a multi-pole electromagnetic release and a device implemented by adopting the method. The multi-pole electromagnetic release which is a new-generation electromagnetic release with an adjustable release threshold designed on the basis of a new energy balance principle can completely balance various electromagnetic and mechanical variant elements related to adjustment of a release threshold by adopting a simple, small-size and feasible optimized structure, not only can realize maximization of a release threshold adjustable range and minimization of an error between the actual release action current value and a set release threshold, but also has stable and reliable release action performances under various adjusting states, including a large release threshold and a small release threshold.

To achieve the objective, the invention adopts the following technical solutions:

It is provided a short-circuit protection action current adjusting method for a multi-pole electromagnetic release, wherein an electromagnetic system 101 of the electromagnetic release comprises an auxiliary static iron core 18, a second static iron core 21, a coil 23, a reset spring 24 and a dynamic iron core 25; at an initial position, a second gap L2 is formed between the dynamic iron core 25 and the second static iron core 21, and the thickness of the second gap L2 changes in the same direction along with the size variation of a release threshold; the elastic force of the reset spring 24 changes oppositely along with the size variation of the release threshold; when a release current value is adjusted from large to small, the self-induction magnetic energy of the coil 23 reduces in a quadratic relationship mode along with flowing currents and meanwhile the electromagnetic attraction between the dynamic iron core 25 and the second static iron core 21 is increased in a quadratic relationship mode, which is in inverse proportion to reduction of the thickness of the second gap L2; adjustment of the release current value and electromagnetic attraction required by actions of the dynamic iron core 25 are in a linear fixed corresponding relation due to automatically achieved balance between two quadratic functions.

A further preferred embodiment lies in that: a first gap L1 for balancing leakage flux is formed between the dynamic iron core 25 and the auxiliary static iron core 18, the thickness of the first gap L1 changes oppositely along with the size variation of the thickness of the second gap L2, and the sum of the thicknesses of the first gap L1 and the second gap L2 is kept always unchanged.

The technical scheme of the present invention further comprises a short-circuit protection action current adjusting device for a multi-pole electromagnetic release, which adopts and implements the preceding short-circuit protection action current adjusting method for the multi-pole electromagnetic release, the adjusting device comprising a base 34 and a release threshold adjusting device 103 which are commonly used by each pole, electromagnetic systems 101 mounted on the base 34, connecting devices 102 for performing transmission between the release threshold adjusting device 103 and the electromagnetic systems 101, and connecting rods 17 for transferring a release action. Each electromagnetic system 101 comprises a coil framework 22 with a hollow cavity, a second static iron core 21 and an auxiliary static iron core 18 fixed at two ends of the hollow cavity of the coil framework 22 respectively, a coil 23 sheathed on the coil framework 22, a magnetic yoke 19 fixedly connected with the second static iron core 21 and the auxiliary static iron core 18 respectively, a dynamic iron core 25 arranged inside the hollow cavity of the coil framework 22 in a mode of being capable of linearly moving between the second static iron core 21 and the auxiliary static iron core 18, and a reset spring 24 positioned inside the coil framework 22 by the dynamic iron core 25 and the second static iron core 21 and used for driving the dynamic iron core 25 to be separated from the second static iron core 21. The connecting rod 17 is arranged inside a central hole 180 of the auxiliary static iron core 18 and comprises an inner end 171 fixedly connected to one end of the dynamic iron core 25 and an outer end 172 connected to and in linkage to the connecting device 102. A first gap L1 is formed between the auxiliary static iron core 18 and the dynamic iron core 25, and a second gap L2 is formed between the second static iron core 21 and the dynamic iron core 25; in a process that the release threshold adjusting device 103 drives the movable iron core 25 to move by the connecting rod 17 to perform adjustment, a release threshold of the release threshold adjusting device 103 is in linkage with the first gap L1 and the second gap L2, and meanwhile satisfies the following variation relationships: the thickness of the second gap L2 changes in the same direction along with the size variation of the release threshold, the thickness of the first gap L1 changes oppositely along with the size variation of the thickness of the second gap L2, and the sum of the thicknesses of the first gap L1 and the second gap L2 is always kept unchanged.

Another specific preferred embodiment lies in that: the release threshold adjusting device 103 comprises a support 32 fixedly arranged on the base 34, a rotary knob 11 pivotally arranged on the support 32, a drag rod 29 pivotally arranged on the base 34 in a manner of being capable of axially moving, and trimmer screws 13, wherein a gear 30 is arranged at the lower end part of the rotary knob 11; the drag rod 29 is provided with a rack 31 meshed with the gear 30 on the rotary knob 11, a plurality of outwards stretching rods 15, a plurality of threaded holes 38, a lock catch 37 for outputting a release action and a reset locating surface 36, wherein each rod 15 is respectively in fit joint with the connecting device 102 at a pole where the rod is located, and the trimmer screw 13 is arranged in each threaded hole 38.

A further specific preferred mode lies in that: the connecting device 102) is arranged on a magnetic yoke 19 of the magnetic system 101 at a pole where the connecting device is located, through a guideway pair in a manner of being capable of linearly moving; the connecting device 102 is provided with a fixed groove 62 which is connected to and in linkage with the outer end 172 of the connecting rod 17 of the magnetic system 101, a linear contour surface 14 which is cooperatively connected with the rods 15 of the release threshold adjusting device 103, and a curved contour surface 33 which is in contact fit with the trimmer screws 13 of the release threshold adjusting device 103; a linear movement direction B of the connecting device 102 is parallel to a linear movement direction A of the connecting rod 17.

A yet another specific preferred embodiment lies in that: one end of the dynamic iron core 25 is coaxially and fixedly connected with the inner end 171 of the connecting rod 17, the other end of the dynamic iron core 25 is provided with a coaxial hole 250 corresponding to the inner end 171, and the second static iron core 21 is provided with an axial hole 210 corresponding to the coaxial hole 250 in the dynamic iron core 25.

A further preferred embodiment lies in that: one end of the reset spring 24 is mounted inside the coaxial hole 250 of the dynamic iron core 25 in an abutting manner, and the other end of the reset spring 24 is mounted inside the axial hole 210 of the second static iron core 21 in an abutting manner.

Another specific preferred embodiment lies in that: a connecting rod 17 driven by the release threshold adjusting device 103 is preferably made of a nonmagnetic material.

A further preferred embodiment lies in that: the guideway pair comprises two positioning lugs 16 and 16' arranged on the connecting device 102 and two guideway grooves 39 arranged on the magnetic yoke 19.

A yet further preferred embodiment lies in that: a distribution direction C of the linear contour surface 14 is perpendicular to a linear movement direction B of the connecting device 102, and a curved contour surface 33 is provided with a continuously changed head H along the distribution direction C.

According to the short-circuit protection action current adjusting method for a multi-pole electromagnetic release and the device implemented by adopting the method of the present invention, by virtue of a series of optimized designs for structures and parameters, namely the coil 23, the magnetic yoke 19, the second static iron core 21, the auxiliary static iron core 18, the dynamic iron core 25, the coil framework 22, the first gap L1 between one end of the dynamic iron core 25 and the auxiliary static iron core 18 and the second gap L2 between the other end of the dynamic iron core 25 and the second static iron core 21, a release action current and a critical distance of an attraction action between the dynamic iron core and the static iron core (namely the thickness of second gap L2 between the dynamic iron core 25 and the second static iron core 21) are obtained, the release action current and the thickness of the second gap L2 are in a linear function relationship due to the implementation of automatic linear balance, and an effect of expanding the release threshold adjustable range to a great extent is realized by using such linear function relationship; meanwhile, the release performance and the action quality can be further improved greatly, that is, the actual release action current value of the circuit breaker has desired precision, reliability and stability regardless of the size of a set release threshold.

DETAILED DESCRIPTION OF THE PREFERRED EMBODIMENTS

The specific embodiments of the short-circuit protection action current adjusting method and device thereof the present invention will be described in detail as below by taking a three-pole circuit breaker as an example in conjunction with FIGS. 1 to 8. The present invention will be not limited to the description of the following embodiments.

Figure 1:
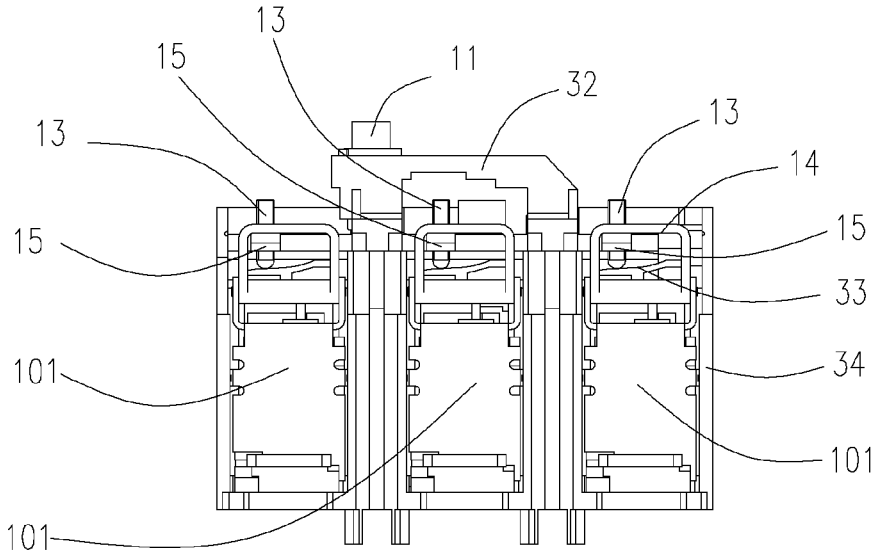
FIG. 1 and FIG. 2 are overall structural schematic drawings of a short-circuit protection action current adjusting device for a multi-pole electromagnetic release, where the electromagnetic release shown in FIG. 1 is at a large release threshold state, and the electromagnetic release shown in FIG. 2 is at a small release threshold state.
Figure 2:
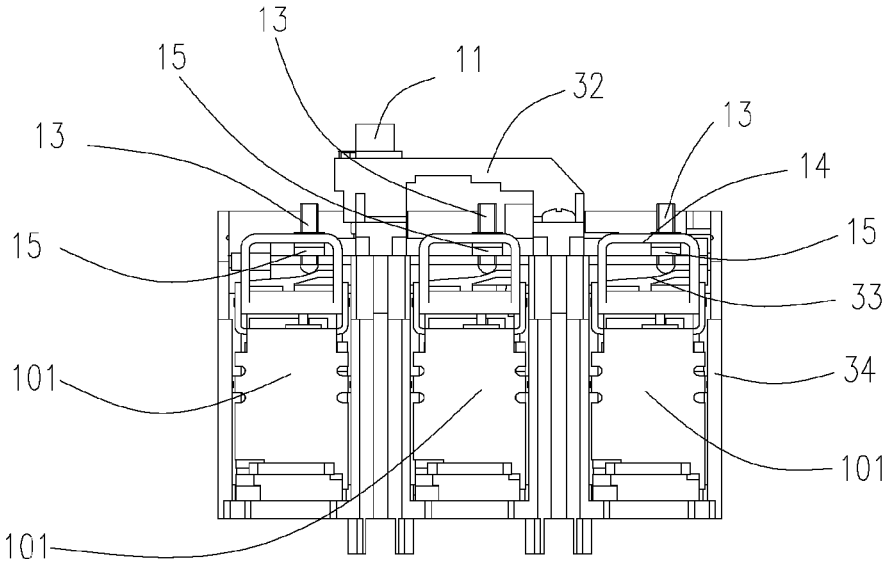
Figure 3:
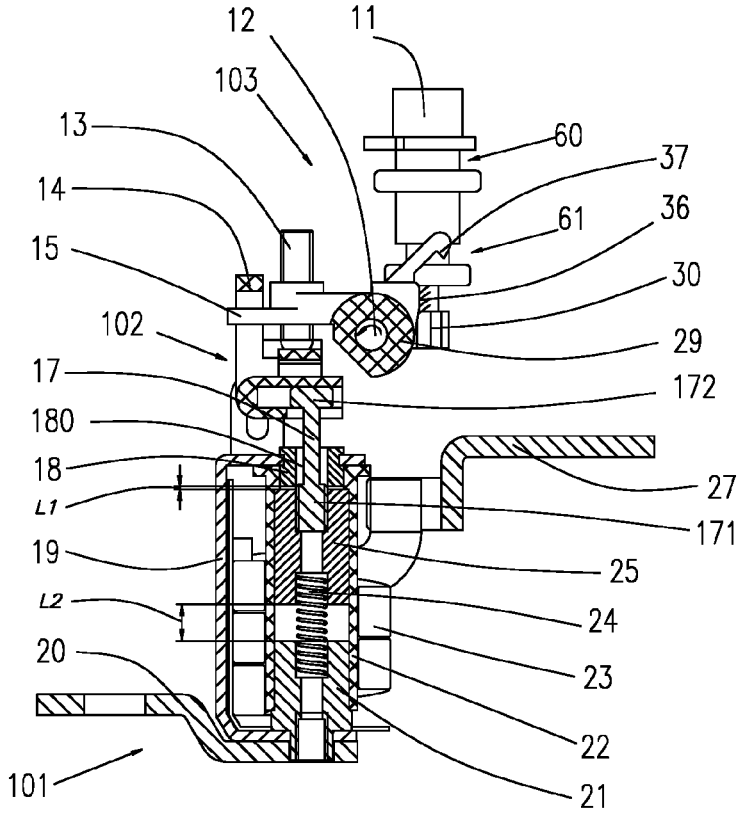
FIG. 3 and FIG. 4 are internal structural schematic drawings of the short-circuit protection action current adjusting device for the multi-pole electromagnetic release, where the electromagnetic release shown in FIG. 3 is at a large release threshold state, and the electromagnetic release shown in FIG. 4 is at a small release threshold state.
Figure 4:
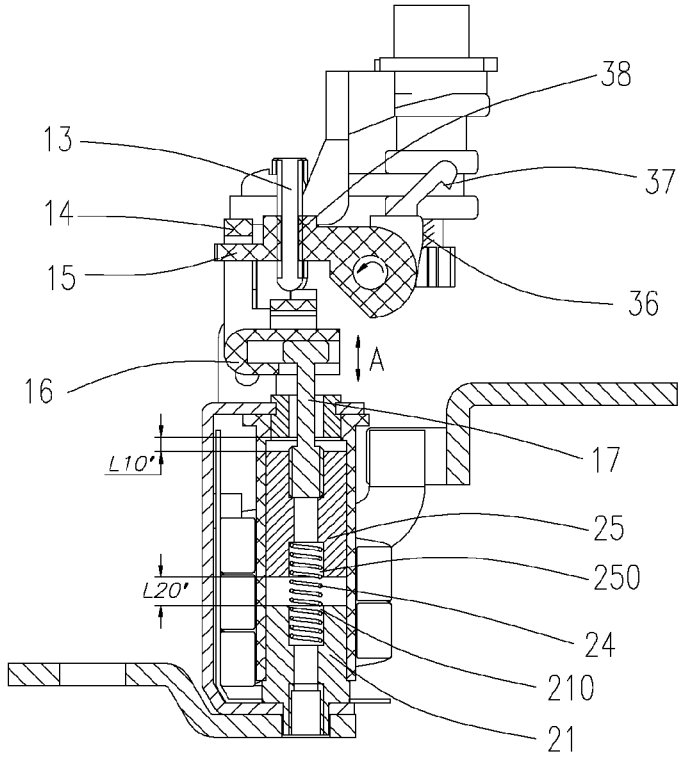

A three-pole electromagnetic release in the overall structural schematic drawing in FIG. 1 and FIG. 2 according to the embodiment of the present invention is a component of a circuit breaker, comprising a base 34 commonly used by three poles, a release threshold adjusting device 103 commonly used by three poles, three electromagnetic systems 101, three connecting devices 102 and connecting rods 107. The electromagnetic release as shown in FIG. 1 is at a large release threshold state, and the electromagnetic release as shown in FIG. 2 is at a small release threshold state. The three electromagnetic systems 101 are respectively arranged at three poles of the circuit breaker, and each electromagnetic system 101 is equipped with the connecting device 102. The base 34 as shown in FIG. 1 and FIG. 2 is also a shell base of the circuit breaker. The base 34 is not only provided with the electromagnetic systems 101, the release threshold adjusting device 103 (referring to FIG. 3) and other components, but also is provided with other well-known components of the circuit breaker, including an operating mechanism (not shown in drawings) and a wiring device (not shown in drawings) of the circuit breaker. Referring to FIG. 1, each electromagnetic system 101 is fixedly mounted inside the base 34 and comprises a conducting plate 20, a conducting plate 27, a magnetic yoke 19, an auxiliary static iron core 18, a second static iron core 21, a dynamic iron core 25, a spring 24, a coil framework 22 and a coil 23, wherein the conducting plates 20 and 27 and the coil 23 are welded together, the two static iron cores 18 and 21 are respectively fixed at two ends of the magnetic yoke 19 and are limited by the coil framework 22, the dynamic iron core 25 is mounted inside the coil framework 22 and is capable of moving back and forth between the two static iron cores 18 and 21, and the spring 24 is mounted inside the coil framework 22 and is positioned by the dynamic iron core 25 and the second static iron core 21. FIGS. 3-4 illustrate an internal structure of the electromagnetic system 101 of one pole and one connecting device 102. Referring to FIGS. 3-4, at an initial position, a first gap L1 is formed between the dynamic iron core 25 and the auxiliary static iron core 18, a second gap L2 is formed between the dynamic iron core 25 and the second static iron core 21, where a total gap L=L1+L2 and L2>L1; the dynamic iron core 25 moves between the auxiliary static iron core 18 and the second static iron core 21, with the total gap L being always kept unchanged.

Based on repeated advanced studies made by the applicant for a long time on factors, which cannot be comprehensively balanced and which affect a linear function relationship between the elastic deformation and the elastic force of the reset spring, a function relationship in which the magnetic field energy of the electromagnetic coil is in direct proportion to the quadratic of a threshold action current, and a complicated nonlinear non-trigonometric function relationship between the electromagnetic attraction between the dynamic iron core and the static iron core and the release action current, the applicant finds that the problem on the existing elastic force balance model represented by the patent ZL200820214752.8 is resulted from the adoption of a linkage relationship in which the elastic force of the reset spring changes in the same direction along with the release threshold, completely aside from a linkage relationship of corresponding variations between the magnetic gap and the release threshold, that is, the large release threshold corresponds to a large elastic force of the reset spring, and the small release threshold corresponds to a small elastic force of the reset spring; the thickness of a magnetic gap between the dynamic iron core and the static magnetic gap is unchanged no matter the release threshold is adjusted to a larger value or a smaller value. But, because the structure function of the reset spring objectively decides that the large elastic force only corresponds to a small magnetic gap between the dynamic iron core and the static iron core, rather than a large magnetic gap, and the small elastic force only corresponds to the large magnetic gap, rather than the small magnetic gap. Therefore, the applicant considers that the elastic force balance in the prior art is wrong just at excluding a correspondingly changed linkage relationship that should be built between the magnetic gap and the release threshold, and this just causes a conventional design misunderstanding with poor reliability. It is just opposite to this in the prior art, and in the present invention, the thickness of the second gap L2 can change structurally in the same direction along with the size variation of the release threshold on the basis of the energy balance principle, namely, it is intended to build a linkage relationship in which the magnetic gap between the dynamic iron core and the static iron core changes in the same direction along with the release threshold. The so-called change herein in the same direction means that the large release threshold corresponds to a large thickness of the second gap L2, and the small release threshold corresponds to a small thickness of the second gap L2. That is to say, because the smaller the thickness of the second gap L2 is, the larger the electromagnetic attraction between the dynamic iron core 25 and the second static iron core 21 is. The linkage variation relationship in which the thickness of the second gap L2 changes in the same direction along with the size variation of the release threshold can make the elastic force of the reset spring change oppositely along with the size variation of the release threshold, that is, the large release threshold corresponds to the small elastic force of the reset spring, and the small release threshold corresponds to the large elastic force of the reset spring. To be specific, because the self-induction magnetic energy of a solenoid coil 23 (hereinafter referred to as a "coil") is in direct proportion to the quadratic of a current flowing through the coil 23, and the electromagnetic attraction between the dynamic iron core 25 and the second static iron core 21 is in inverse proportion to the quadratic of the thickness of the second gap L2 between the dynamic iron core 25 and the second static iron core 21. According to the method disclosed by the invention, the two quadratic functions are automatically balanced in design, and the following effects of a first balance model can be realized: when the release current value is adjusted from large to small, the self-induction magnetic energy of the coil 23 can be reduced in a quadratic relationship mode; meanwhile, the electromagnetic attraction between the dynamic iron core 25 and the second static iron core 21 is increased in a quadratic relationship mode due to the reduction of the second gap L2, and the balance therebetween can make the release current value and the electromagnetic attraction required for actions of the dynamic iron core 25 form a linear fixed corresponding relationship. However, proceeding from the effects of the first balance model, it is necessary to balance other function relationships related to coil energy and electromagnetic attraction, especially some nonlinear function relationships, in order to realize the linear fixed corresponding relationship. The magnetic gap between the dynamic iron core and the static iron core has leakage flux. When the second gap L2 changes, the leakage flux thereof also changes therewith, and a complicated function relationship is present among the leakage flux, the coil energy and the electromagnetic force. In order to realize that the energy of the corresponding coil 23 becomes larger and meanwhile the thickness of the second gap L2 also becomes larger when the set release threshold becomes larger, or on the contrary, the energy of the corresponding coil 23 becomes smaller and meanwhile the thickness of the second gap L2 also becomes smaller when the set release threshold becomes smaller, a simple, feasible and effective method of the present invention is to adopt a second balance model for balancing leakage flux, in which a first gap L1 is additionally formed at an initial position between the dynamic iron core 25 and the auxiliary static iron core 18 as a leakage flux loop, and end areas of opposite ends of the static iron core 18 and the second static iron core 21 are kept to be equal. The method can realize the following effects of the second balance model: no matter how to adjust, the total gap L=L1+L2 is always kept unchanged, that is, the leakage flux is unchanged; it is intended in the present invention to destroy the original linear balance relationship between the release threshold and the energy of the coil 23 (the leakage flux increases when the thickness of the second gap L2 becomes larger), thereby realizing the conformity between the set release threshold and the actual action current value of a release mechanism, and therefore, a desired linear smooth variation to adjustment of the release threshold can be realized easily by means of the rotary knob and scales provided thereon. It can thus be seen that the energy balance model of the present invention not only comprises a magnetic balance element and an elastic balance element, but also comprises a plurality of balance elements of leakage flux, magnetic conductivity and the like related to energy. The first balance model and the second balance model in the present invention are results obtained on the basis of a new objective knowledge of an electromagnetic principle of an instantaneous electromagnetic release device, in accordance with skillful application of the electromagnetic fundamental theory and in conjunction with actual researches, to overcome the cognitive bias against the prior art.

The optimized structure of the device of the present invention will be described in detail as below in conjunction with a short-circuit protection action current adjusting method for a multi-pole electromagnetic release based on an energy balance principle, such that the difference from the design based on an elastic force balance principle of the prior art becomes more clear and is easily understood.

Referring to FIGS. 1-4, the electromagnetic system 101 comprises a coil framework 22 with a hollow cavity, a second static iron core 21 and an auxiliary static iron core 18 fixed at two ends of the hollow cavity of the coil framework 22 respectively, a coil 23 sheathed on the coil framework 22, a magnetic yoke 19 fixedly connected with the second static iron core 21 and the auxiliary static iron core 18 respectively, a dynamic iron core 25 arranged inside the hollow cavity of the coil framework 22 in a mode of being capable of linearly moving between the second static iron core 21 and the auxiliary static iron core 18, and a reset spring 24 positioned inside the coil framework 22 by the dynamic iron core 25 and the second static iron core 21 and used for driving the dynamic iron core 25 to be separated from the second static iron core 21. The connecting rod 17 is mounted inside a central hole 180 of the auxiliary static iron core 18 and comprises an inner end 171 fixedly connected to one end of the dynamic iron core 25 and an outer end 172 connected and in linkage to the connecting device 102. a known structure may be adopted for an electric structure in which two conducting plates 20 and 27 at two ends of the coil 23 are connected with a main circuit of a circuit breaker in series. The magnetic yoke 19 having a concave structure is fixedly connected with the second static iron core 21 and the auxiliary static iron core 18 respectively, such that the magnetic yoke 19, the second static iron core 21, the auxiliary static iron core 18, the coil framework 22 and the coil 23 are connected into a whole, wherein the magnetic yoke 19 not only has a magnetic conduction function, but also has a stand function of the electromagnetic system 101; location and installation of the electromagnetic system 101 on the base 34 can be realized through fixed connection between the magnetic yoke 19 and the base 34. By means of the structure in which the coil 23 is sheathed on the coil framework 23, a current flowing through the coil 23 can generate an induction magnetic field inside the hollow cavity of the coil framework 22. As known on the basis of the electromagnetic principle, the energy of the induction magnetic field is in direct proportion to the quadratic of a current flowing through the coil 23 in case that the shape structures and parameters of the coil 23, the magnetic yoke 19, the second static iron core 21, the auxiliary static iron core 18, the dynamic iron core 25 and the coil framework 22 are determined. As mentioned above, a first gap L1 for balancing leakage flux is established in structure on the basis of the energy balance principle, and a linkage relationship in which the thickness of the first gap L1 changes oppositely along with the size variation of the thickness of the second gap L2, and the sum of the thicknesses of the first gap L1 and the second gap L2 is always kept unchanged is also established. The opposite change described here means: the first gap L1 reduces when the second gap L2 increases; and on the contrary, the first gap L1 increases when the second gap L2 reduces. The linkage variation relationship will be further illustrated as below in conjunction with FIG. 3 and FIG. 4, wherein the electromagnetic release as shown in FIG. 3 is at a large release threshold state, and the electromagnetic release as shown in FIG. 4 is at a small release threshold state. It is set that the thickness of the first gap L1 is L10 and the thickness of the second gap L2 is L20 under the state in FIG. 3, when the release threshold is adjusted to be smaller till reaching the state in FIG. 4, the first gap L1 increases (the thickness L10'>L10) as the second gap L2 reduces (the thickness L20'<L20), but the sum of the thicknesses of the first gap L1 and the second gap L2 is always kept unchanged, namely L10+L20=L10'+L20'. Obviously, by establishing a structure of the first gap L1 and by virtue of a linkage variation relationship of unchanged L1+L2, the interference of leakage flux to a linear fixed corresponding relationship between the release threshold and the electromagnetic force can be effectively avoided. In order to obtain a preferred fixed corresponding effect of the second balance model for balancing leakage flux, an optional structure scheme is that: one end of the dynamic iron core 25 is coaxially and fixedly connected with the inner end 171 of the connecting rod 17, and the other end of the dynamic iron core 25 is provided with a coaxial hole 250 corresponding to the inner end 171. Obviously, by additionally arranging the coaxial hole 250, two end areas of two ends of the dynamic iron core 25 are equal in size as much as possible, or to say, an end area of one end, participating in forming the first gap L1, of the dynamic iron core 25 is made to be equal to an end area of the other end, participating in forming the second gap L2, of the dynamic iron core 25 in size as much as possible. In order to further obtain a better fixed corresponding effect, another preferred structure scheme is that: the second static iron core 21 is provided with an axial hole 210 corresponding to the coaxial hole 250 in the dynamic iron core 25. Obviously, by additionally arranging the axial hole 210, an end area, participating in forming the second gap L2, of the second static iron core 21 is made to be equal to an end area, participating in forming the first gap L1, of the auxiliary static iron core 18 in size as much as possible.

The structural optimized design of a linear function relationship between the release action current and the thickness of the second gap L2, which is implemented in the present invention, is characterized in that: the connecting rod 17 is mounted inside the central hole 180 of the auxiliary static iron core 18, the inner end 171 of the connecting rod 17 is fixedly connected with one end of the dynamic iron core 25, and the outer end 172 of the connecting rod 17 is connected and in linkage with the connecting device 102. In a process that the release threshold adjusting device 103 drives the dynamic iron core 25 to move by the connecting rod 17 to perform adjustment, a release threshold of the release threshold adjusting device 103 is in linkage with the first gap L1 and the second gap L2, and meanwhile satisfies the following variation relationships: the thickness of the second gap L2 changes in the same direction along with the size variation of the release threshold, the thickness of the first gap L1 changes oppositely along with the size variation of the thickness of the second gap L2, and the sum of the thicknesses of the first gap L1 and the second gap L2 is always kept unchanged. The first gap L1 is only used for balancing leakage flux, and the second gap L2 is used for realizing balance with the release threshold. Because the attraction force is in direct proportion to the energy of the coil 23, and the energy of the coil 23 is in inverse proportion to the thickness of the second gap L2, the energy can be kept unchanged; a linear relationship between the attraction force and the energy is kept unchanged as long as the energy is kept unchanged, because the quadratic function of the release current action value and a quadratic function of the thickness of the second gap L2 are automatically balanced, that is, the size of the release threshold changes in the same direction along with the thickness of the second gap L2.

Referring to FIG. 3, the auxiliary static iron core 18 of the present invention is made of a magnetic material. The auxiliary static iron core 18 provides four structural features capable of realizing different functions: 1, the auxiliary static iron core 18 is a device in a magnetic circuit; 2, the auxiliary static iron core 18 is fixedly connected with the magnetic yoke 19 and the coil framework 22 and is an essential connecting part constituting a stand of the electromagnetic system 101; 3, the auxiliary static iron core 18 forms a first gap L1 having a function of balancing leakage flux together with the dynamic iron core 25, and is provided with an end surface constituting the first gap L1; 4, the auxiliary static iron core 18 has a central hole 180 allowing the connecting rod 17 to pass through, the central hole 180 forming a mechanical fit relationship with the connecting rod 17. In order to reduce factors adverse to energy balance caused by the fit relationship as much as possible, an effective measure is that: the connecting rod 17 is preferably made of a nonmagnetic material. The following structure of the auxiliary static iron core 18 and the connecting rod 17 further constitutes a third balance model based on an energy balance principle: because the connecting rod 17 is mounted inside the central hole 180 of the auxiliary static iron core 18, the inner end 171 of the connecting rod 17 is fixedly connected with one end of the dynamic iron core 25, and the outer end 172 of the connecting rod 17 is connected and in linkage with the connecting device 102. Therefore, this structure has the following effect: in a process of adjusting the release threshold, the length of the connecting rod 17 inside the hollow cavity of the coil framework 22 (referred to as "in-cavity length") changes in the same direction along with the size variation of the release threshold, that is: the in-cavity length of the connecting rod 17 increases when the release threshold increases; the in-cavity length of the connecting rod 17 reduces when the release threshold reduces. In case that the connecting rod 17 is made of a magnetic material, the variation of the volume of the connecting rod 17 inside the hollow cavity of the coil framework 22 (referred to as an "in-cavity volume") caused by the variation of the in-cavity length of the connecting rod 17 will cause the variation of the self-induction magnetic energy of the solenoid coil 23; in case that the connecting rod 17 is made of a nonmagnetic material, the variation of the volume of the connecting rod 17 inside the hollow cavity of the coil framework 22 (referred to as an "in-cavity volume") caused by the variation of the in-cavity length of the connecting rod 17 will not cause the variation of the self-induction magnetic energy of the solenoid coil 23. As an optimized scheme, the connecting rod 17 is made of the magnetic material, but it is not excluded in the present invention that the connecting rod 17 is made of the magnetic material. If the connecting rod 17 is made of the magnetic material, it is necessary to satisfy the condition that the elastic force of the reset spring 24 changes in the same direction along with the variation of the in-cavity volume of the connecting rod 17, so as to establish a balance model of a function relationship formed by the in-cavity volume of the connecting rod 17 and the elastic force of the reset spring 24, which is beneficial to forming a linear fixed corresponding relationship between the release current value and the electromagnetic attraction required for actions of the dynamic iron core 25. The reset spring 24 as shown in FIG. 3 and FIG. 4 is a pressure spring which is mounted in the middle of the second gap L2 inside the hollow cavity of the coil framework 22. Two ends of the reset spring 24 are connected with the dynamic iron core 25 and the second static iron core 21 respectively. To further simplify the structure, a preferred scheme is that: the installation of the reset spring 24 can be realized directly by means of existing functional holes in the dynamic iron core 25 and the second static iron core 21, that is: one end of the reset spring 24 is mounted inside the coaxial hole 250 of the dynamic iron core 25 in an abutting manner, and the other end of the reset spring 24 is mounted inside the axial hole 210 of the second static iron core 21 in an abutting manner. The abutting installation here refers to installation of a known abutting structure, for example, the coaxial hole 250 and the axial hole 210 are internally provided with abutting steps respectively, the reset spring 24 is mounted inside the holes (the coaxial hole 250 and the axial hole 210), and meanwhile, the end part of the reset spring 24 butts against the steps to limit axial and radial movements of the reset spring 24. Compared with the prior art, the advantages of the spring installation structure of the above embodiment are apparent, which not only simplify the structure, but also make the elastic force of the reset spring 24 and the electromagnetic attraction be in the same acting force and overcome the defect that an included angle is present between the elastic force acting direction of the existing patent and a movement direction of the dynamic iron core, that is, it is necessary to additionally arrange a sliding pair which is composed of a short shaft and a sliding groove and of which the movement direction is perpendicular to the movement direction of the dynamic iron core inside an elastic transport chain. Of course, it is not excluded in the present invention to adopt an alternative scheme in which the reset spring is arranged inside the hollow cavity of the coil framework or a tension spring or other type of spring.

Figure 7:
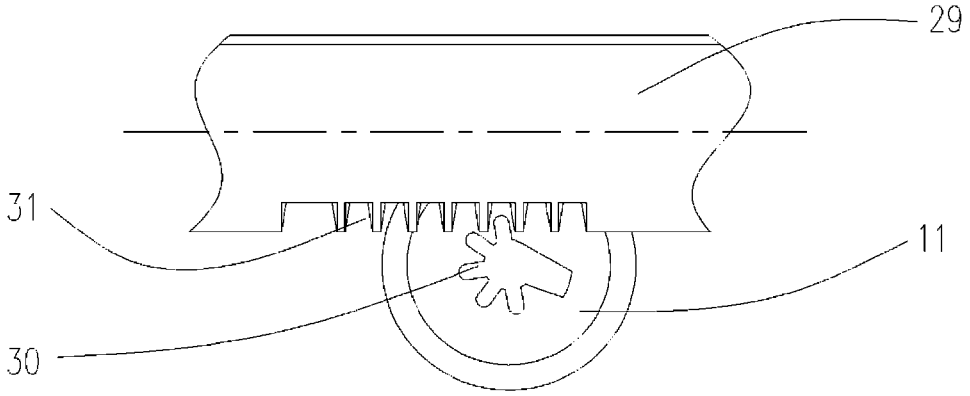
FIG. 7 is a structural schematic drawing in which a rack 31 on a drag rod 29 of the release threshold adjusting device 103 and a gear 30 on a rotary knob 11 are meshed according to the short-circuit protection action current adjusting device for the multi-point electromagnetic release of the present invention.
Figure 8:
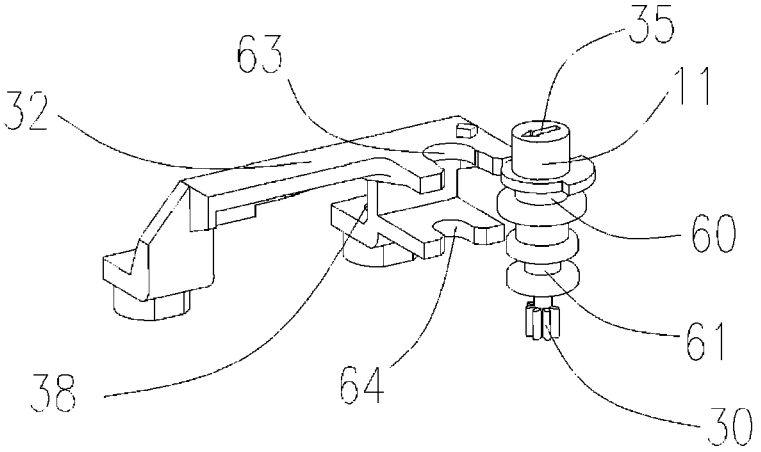
FIG. 8 is an exploded structural schematic drawing in which the rotary knob 11 of the release threshold adjusting device 103 and the support 32 are pivotally mounted according to the short-circuit protection action current adjusting device for the multi-point electromagnetic release of the present invention.

Referring to FIGS. 3-4, the short-circuit protection action current adjusting device for a multi-pole electromagnetic release is associated with an operating structure as for a mechanical structure, and is associated with a wiring device as for a circuit structure, to be specific: a lock latch 37 for outputting a release action is in fit joint with a trip lever of the operating mechanism, such that the release action of the lock latch 37 can directly drive the circuit breaker to trip. As an instantaneous release with an adjustable release threshold, under normal circumstances, the coil 23 of the electromagnetic system 101 is connected to a main circuit of one pole of the circuit breaker in series, i.e., connected between an input wiring device and an output wiring device of one pole of the circuit breaker in series. When a current flowing through the coil 23 reaches or exceeds a set release action current threshold (hereinafter referred to as a "release threshold"), the dynamic iron core 25 of the electromagnetic system 101 generates a release action which is transferred to the lock latch 37 of the release threshold adjusting device 103 through the connecting rod 17 and the connecting device 102. The release action generated by any one of three electromagnetic systems 101 will render the circuit breaker to release and trip. Referring to FIGS. 1-4 and FIGS. 7-8, the release threshold adjusting device 103 comprises a support 32 fixedly mounted on the base 34, a rotary knob 11 pivotally mounted on the support 32, a drag rod 29 and trimmer screws 13, wherein the rotary knob 11 simultaneously adjusts release thresholds of the three electromagnetic systems 101; a gear 30 is arranged at the lower end part of the rotary knob 11; the drag rod 29 is pivotally mounted on the base 34 in a manner of axially moving; the drag rod 29 is provided with a rack 31 meshed with the gear 30 on the rotary knob 11, a plurality of outwards stretching rods 15, a plurality of threaded holes 38, a lock latch 37 for outputting a release action and a reset limiting surface 36, wherein each rod 15 is in fit joint with the connecting device 102 at a pole where the pole 15 is located, the trimmer screw 13 is mounted inside each threaded hole 38, and the reset limiting surface 36 is matched with the base 34 to limit the drag rod 29 to rotate clockwise under a reset state and provide a stable reset state for the drag rod 29. The "fit joint" described here refers to joint of contact fit and separate fit, referring to FIGS. 3-4 for detail; under a reset state, the rods 15 are not in contact with a linear contour surface 14 of the connecting device 102, thereby leaving a movement travel of the connecting device 102 for adjusting the release threshold; in a release process, the connecting rod 102 moves to drive the linear contour surface 14 to move, such that the linear contour surface 14 is in contact with the rods 15, and then the linear contour surface 14 drives the rods 15 to act. The structure in which the rotary knob 11 is pivotally mounted on the support 32 is shown in FIG. 8, including two openings 63 and 64 coaxially formed in the support 32 and two concave shaft segments 61 and 62 coaxially arranged on the rotary knob 11, wherein the two shaft segments 61 and 62 are mounted inside the two openings 63 and 64 respectively to constitute a rotating pair mechanism for realizing pivotal installation of the rotary knob 11. A support structure of a known rotating shaft can be adopted for a structure in which the drag rod 29 is mounted on the base 34. This structure has an effect of limiting four degrees of freedom on the drag rod 29, and only allows the drag rod 29 still to have two degrees of freedom of rotation and axial movement. When the rotary knob 11 is rotated, the gear 30 at the lower end part of the rotary knob 11 as shown in FIG. 8 drives the rack 31 on the drag rod 29 as shown in FIG. 7, such that the drag rod 9 does an axial movement. When an action is input from the rods 15 or the lock latch 37 inputs an action, the rods 15 or the lock latch 37 may drive the drag rod 29 to rotate, and the rotation of the drag rod 29 realizes the linkage of the rods 15 and the lock latch 37 about an axis. The trimmer screws 13 as shown in FIG. 3 are paired with the threaded holes 38 as shown in FIG. 8, and the number of the trimmer screws 13 and the number of the threaded holes 38 are equal to the number of poles of the circuit breaker. The lock latch 37 is in fit joint with a trip lever of an operating mechanism of the circuit breaker and outputs a release action by which the lock latch 37 rotates about the drag rod 29 to the trip lever, the fit joint structure being a frequently-used structure. The top end surface of the rotary knob 11 is provided with an adjusting groove 35 which is of an arrow shape as shown in FIG. 8. Markers (not shown in FIG. 8) indicating the release thresholds are arranged in a region, which corresponds to the arrow, on the outer surface of the base 34. When the rotary knob 11 is rotated, the arrow can point to the markers indicating different release thresholds. The adjusting groove 35 can allow a tool (a screwdriver, for instance) to be inserted to drive the rotary knob 11 to rotate.

Figure 5:
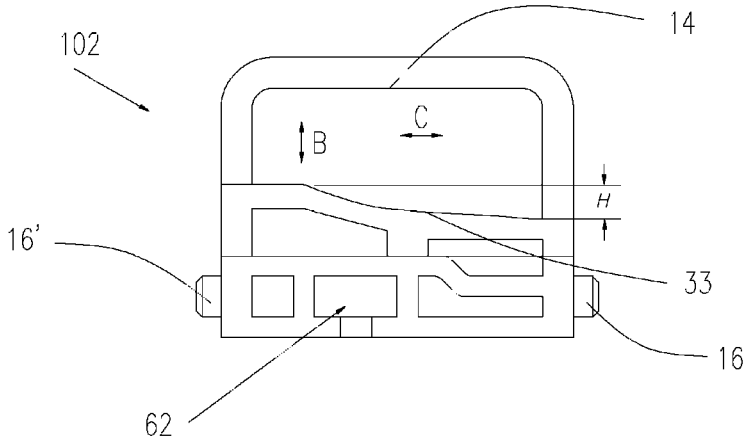
FIG. 5 is an overall structural schematic drawing of a scheme of a connecting device 102 of the short-circuit protection action current adjusting device for the multi-pole electromagnetic release of the present invention.
Figure 6:
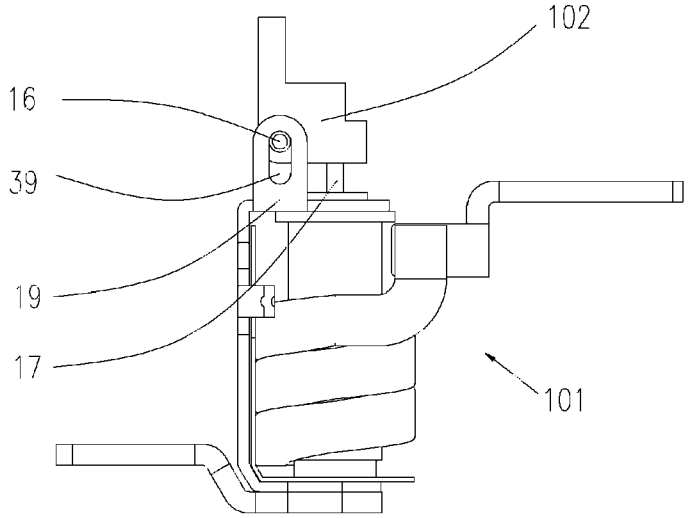
FIG. 6 is a structural schematic drawing in which the connecting device 102 and the electromagnetic system 101 are assembled according to the short-circuit protection action current adjusting device for the multi-pole electromagnetic release of the present invention.

Referring to FIGS. 1-6, the connecting device 102 is arranged on the magnetic yoke 19 of the electromagnetic system 101 at a pole where the connecting device 102 is located, through a guideway pair in a manner of being capable of linearly moving; the connecting device 102 is provided with a fixed groove 62 which is connected and in linkage with the outer end of the connecting rod 17 of the electromagnetic system 101, a linear contour surface 14 which is in fit joint with the rods 15 of the release threshold adjusting device 103, and a curved contour surface 33 which is in contact fit with the trimmer screws 13 of the release threshold adjusting device 103; a linear movement direction B of the connecting device 102 is parallel to a linear movement direction A of the connecting rod 17. The fit joint described here refers to the above-mentioned meaning. The "contact fit" refers to the fit of contact and separation, referring to FIGS. 4-5 for details: under a reset state, the curved contour surface 33 is in contact with trimmer screws 13 of the release threshold adjusting device 103; in a release process, the connecting device 102 drives the curved contour surface 33 and the linear contour surface 14 to move downwards while moving, such that the curved contour surface 33 is separated from the trimmer screws 13, then the linear contour surface 14 is in contact with the rods 15, and then the rods 15 are driven by the linear contour surface 14 to act; in a resetting process, the connecting device 102 drives the curved contour surface 33 and the linear contour surface 14 to move upwards while moving, such that the linear contour surface 14 is separated from the rods 15, then the curved contour surface 33 is in contact with the trimmer screws 13, and then the curved contour surface 33 drives the trimmer screws 13 and drives the drag rod 29 to reset. The guideway pair comprises two positioning bosses 16 and 16' (referring to FIG. 5) arranged on the connecting device 102 and two guideway grooves 39 arranged on the magnetic yoke 19, wherein the two positioning bosses 16 and 16' are mounted inside the two guideway grooves 39 respectively, and the guideway grooves 39 are linear grooves to realize a linear movement of the connecting device 102. Referring to FIG. 5, a distribution direction C of the linear contour surface 14 is perpendicular to a linear movement direction B of the connecting device 102, and a curved contour surface 33 is provided with a continuously changed head H along the distribution direction C. The fixed groove 62 is connected with a T-shaped columnar end of the outer end 172 of the connecting rod 17, such that the connecting device 102 is in linkage with the connecting rod 17. It can be understood that the fixed groove 62 which has connection and linkage functions are completely different from sliding grooves disclosed by the patent ZL200820214752.8, there is no a sliding fit relationship between the connecting rod 17 and the fixed groove 62, and therefore various well-known defects caused by a sliding groove structure are avoided.

A release threshold adjusting operation process of the short-circuit protection action current adjusting device for a multi-pole electromagnetic release of the present invention will be illustrated as below in conjunction with FIGS. 1-4. Under the states as shown in FIG. 1 and FIG. 2, the rotary knob is operated to rotate toward a direction of a small release threshold; the gear 30 drives the rack 31 on the drag rod 29, such that the drag rod 29 moves to a position as shown in FIG. 4 rightward from a position as shown in FIG. 1; meanwhile, the top end of each trimmer screw 13 slides rightwards on the curved contour surface 33 of the connecting device 102 and drives the connecting device 102 to move to a position as shown in FIG. 4 downwards from a position as shown in FIG. 1; meanwhile, the connecting device 102 drives the connecting rod 17 and the dynamic iron core 25 to move to a position as shown in FIG. 4 downwards from a position as shown in FIG. 1, such that the thickness of the second gap L2 reduces to L20', the thickness of the first gap L1 increases to L10', and meanwhile the height of the reset spring 24 reduces and the elastic force increases. On the contrary, under the states in FIG. 3 and FIG. 4, the rotary knob 11 is operated to rotate in a direction of the release threshold from small to large, such that each acting part returns to a state as shown in FIG. 1 and FIG. 2.

A release acting process of the short-circuit protection action current adjusting device for a multi-pole electromagnetic release of the present invention will be illustrated as below in conjunction with FIGS. 1-4. When a current flowing through the coil 23 reaches or exceeds a reset release threshold; the electromagnetic attraction between the dynamic iron core 25 and the second static iron core 21 caused by the self-induction magnetic energy of the coil 23 moves toward a direction of the second static iron core 21 against the elastic force of the reset spring 24 till the dynamic iron core 25 attracts the second static iron core 21; the dynamic iron core 25 moves to drive the connecting rod 17 to move downwards; the connecting rod 17 moves downwards to drive the connecting device 102 to move downwards; the connecting device 102 moves downwards to drive the linear contour surface 14 arranged thereon to move downwards; the linear contour surface 14 is in contact fit with the rods 15 on the drag rod 29 of the release threshold adjusting device 103; the linear contour surface 14 moves downwards to drive the rods 15, thereby driving the drag rod 29 to rotate in an anticlockwise direction (a rotation direction as shown in FIG. 3 and FIG. 4); the drag rod 29 rotates anticlockwise to drive the lock latch 37 to rotate anticlockwise, and the lock catch 37 rotates anticlockwise to render the operating mechanism to release and the circuit breaker to trip. After the circuit breaker trips, a current inside the coil 23 is 0, the coil 23 loses the magnetic energy, the dynamic iron core 25 and the second static iron core 21 lose the electromagnetic attraction, the dynamic iron core 25 moves upwards under the action of the elastic force of the reset spring 24, the dynamic iron core 25 moves upwards to drive the connecting rod 17 and the connecting device 102 to reset, the connecting device 102 resets to drive the linear contour surface 33 arranged thereon to move upwards, the curved contour surface 33 moves upwards to drive the trimmer screws 13 on the drag rod 29 to move upwards, the trimmer screws 13 move upwards to drive the drag rod 29 to rotate clockwise till a limiting surface 36 on the drag rod 29 is limited by the base 34, and moving members and moving parts associated with a release action on the electromagnetic system 101, the connecting device 102 and the drag rod 29 enter a stable reset state.

A trimming process of an initial release threshold of the electromagnetic release with an adjustable release threshold of the present invention will be further illustrated as below in conjunction with FIGS. 1-4: under a reset state, the trimmer screws 14 are operated to rotate, and the trimmable connecting device 102 moves upward and downward to realize the conformity between the initial actual release action current value and the set release threshold and the conformity of actual release action current values of all the poles. Due to the adoption of the energy balance principle, the actual release action current value of each pole has relatively high precision corresponding to the set release threshold, and therefore, it can be guaranteed that the actual release action current value of each pole has relatively high precision corresponding to the set release threshold under different release threshold states, as long as the initial actual release action current value is in conformity with the set release threshold.

It can be understood that various embodiments are illustrative to the present invention, rather than restrictive to the present invention, and any invention creations which do not go beyond the essential spirit scope of the present invention shall fall into the protection scope of the present invention. For example, the embodiments illustrated in FIGS. 1-8 are not limited to the case of three poles, where the number of poles is consistent with the number of the electromagnetic systems 101 mounted on the base 34 and the configuration number of the connecting devices 102 for transmission between the release threshold adjusting device 103 and the electromagnetic systems 101, and the base 34 and the release threshold adjusting device 103 are commonly used.

The invention claimed is:

1. A short-circuit protection action current adjusting device for a multi-pole electromagnetic release, comprising a base and a release threshold adjusting device which are common to each pole, a respective electromagnetic system for each pole mounted on the base, respective connecting devices for performing transmission between the release threshold adjusting device and the electromagnetic systems, and respective connecting rods for each pole for transferring a release action, wherein each of the electromagnetic systems comprises a coil framework with a hollow cavity, a second static iron core and an auxiliary static iron core fixed at two ends of the hollow cavity of the coil framework, a coil sheathed on the coil framework, a magnetic yoke fixedly connected with the second static iron core and the auxiliary static iron core respectively, a dynamic iron core inside the hollow cavity of the coil framework arranged for linear movement between the second static iron core and the auxiliary static iron core, and a reset spring positioned inside the coil framework by the dynamic iron core and the second static iron core and used for driving the dynamic iron core away from the second static iron core;

the connecting rod is arranged inside a central hole of the auxiliary static iron core and comprises an inner end fixedly connected to one end of the dynamic iron core and an outer end connected and in linkage to the connecting device;

a first gap L1 is formed between the auxiliary static iron core and the dynamic iron core, and a second gap L2 is formed between the second static iron core and the dynamic iron core; wherein the release threshold adjusting device drives the connecting rod to move the movable dynamic iron core to perform adjustment thereof, a release threshold set by the release threshold adjusting device controls positioning of the dynamic iron core to adjust the first gap L1 and the second gap L2, and satisfy the following variation relationships: the thickness of the second gap L2 changes in a direction the same as a size variation of the release threshold, the thickness of the first gap L1 changes oppositely to the size variation of the thickness of the second gap L2, and the sum of the thicknesses of the first gap L1 and the second gap L2 is always kept unchanged, further wherein an elastic force of the reset spring changes oppositely to the size variation of the release threshold; wherein when a release current value is adjusted from a larger to a smaller value, a self-induction magnetic energy of the coil reduces in a quadratic relationship mode with electrical current flowing in the coil and an electromagnetic attraction between the dynamic iron core and the second static iron core is increased in a quadratic relationship mode, which is in inverse proportion to reduction of the thickness of the second gap L2; wherein adjustment of the release current value and electromagnetic attraction required by actions of the dynamic iron core are in a linear fixed corresponding relationship due to automatically achieved balance between said two quadratic functions.

2. The short-circuit protection action current adjusting device for a multi-pole electromagnetic release according to claim 1, wherein the release threshold adjusting device comprises a support fixedly arranged on the base, a rotary knob pivotally arranged on the support, a drag rod pivotally arranged on the base for axial movement, and trimmer screws, wherein a gear is arranged at the lower end part of the rotary knob; the drag rod is provided with a rack meshed with the gear on the rotary knob, a plurality of outwards stretching rods, a plurality of threaded holes, a lock catch providing a release action and a reset locating surface, wherein each outwards stretching rod is respectively in a fit joint with the connecting device at a pole where the outwards stretching rod is located, and the trimmer screw is arranged inside each threaded hole.

3. The short-circuit protection action current adjusting device for a multi-pole electromagnetic release according to claim 1, wherein the connecting device is arranged on a magnetic yoke of the electromagnetic system at a pole where the connecting device is located, through a guideway pair for linear movement; the connecting device is provided with a fixed groove which is connected and in linkage with the outer end of the connecting rod of the electromagnetic system, a linear contour surface which is in a fit joint with the rods of the release threshold adjusting device, and a curved contour surface which is in contact fit with the trimmer screws of the release threshold adjusting device; and wherein a linear movement direction B of the connecting device is parallel to a linear movement direction A of the connecting rod.

4. The short-circuit protection action current adjusting device for a multi-pole electromagnetic release according to claim 1, wherein one end of the dynamic iron core is coaxially and fixedly connected with the inner end of the connecting rod, an opposite end of the dynamic iron core is provided with a coaxial hole corresponding to the inner end, and the second static iron core is provided with an axial hole corresponding to the coaxial hole in the dynamic iron core.

5. The short-circuit protection action current adjusting device for a multi-pole electromagnetic release according to claim 4, wherein one end of the reset spring is mounted inside the coaxial hole of the dynamic iron core in an abutting manner, and an opposite end of the reset spring is mounted inside the axial hole of the second static iron core in an abutting manner.

6. The short-circuit protection action current adjusting device for a multi-pole electromagnetic release according to claim 1, wherein the connecting rod driven by the release threshold adjusting device is made of a nonmagnetic material.

7. The short-circuit protection action current adjusting device for a multi-pole electromagnetic release according to claim 3, wherein the guideway pair comprises two positioning bosses arranged on the connecting device and two guideway grooves arranged on the magnetic yoke.

8. The short-circuit protection action current adjusting device for a multi-pole electromagnetic release according to claim 3, wherein a distribution direction C of the linear contour surface is perpendicular to a linear movement direction B of the connecting device, and the curved contour surface is provided with a continuously changed head H along the distribution direction C.

* * * * *